US010215515B1

(12) United States Patent
Kruse

(10) Patent No.: US 10,215,515 B1
(45) Date of Patent: Feb. 26, 2019

(54) FIREARM MAGAZINE HAVING NOSE-DRIVE-CONTROL SPRINGS

(71) Applicant: I.P. Holding Group I, LLC, St. Louis, MO (US)

(72) Inventor: Russell E. Kruse, St. Charles, MO (US)

(73) Assignee: I.P. HOLDING GROUP I, LLC, St. Clair, MO (US)

( * ) Notice: Subject to any disclaimer, the term of this patent is extended or adjusted under 35 U.S.C. 154(b) by 41 days.

(21) Appl. No.: 15/786,185

(22) Filed: Oct. 17, 2017

(51) Int. Cl.
*F41A 9/69* (2006.01)
*F41A 9/68* (2006.01)
*F41A 9/58* (2006.01)

(52) U.S. Cl.
CPC *F41A 9/68* (2013.01); *F41A 9/58* (2013.01); *F41A 9/69* (2013.01)

(58) Field of Classification Search
CPC ..... F41A 9/54; F41A 9/55; F41A 9/56; F41A 9/57; F41A 9/69; F41A 9/70
See application file for complete search history.

(56) References Cited

U.S. PATENT DOCUMENTS

| | | | | |
|---|---|---|---|---|
| 403,765 | A | 5/1889 | Mauser | |
| 452,192 | A | 5/1891 | Pitcher | |
| 1,351,370 | A | 8/1920 | Chase | |
| 1,571,592 | A | 2/1926 | Loomis | |
| 2,396,816 | A | 3/1946 | Boudreau | |
| 2,840,944 | A | 7/1958 | Thompson | |
| 2,870,561 | A | 1/1959 | Colby | |
| 2,895,248 | A | 7/1959 | Sawin | |
| 3,711,981 | A * | 1/1973 | Seecamp | F41A 9/69 42/50 |
| 4,376,407 | A | 3/1983 | Hallqvist et al. | |
| 4,502,237 | A | 3/1985 | Krogh | |
| 4,811,510 | A | 3/1989 | Chesnut | |
| 4,970,818 | A | 11/1990 | Vecchieschi | |
| 5,014,456 | A * | 5/1991 | Kurtz | F41A 9/65 42/50 |
| 5,099,595 | A | 3/1992 | Chesnut et al. | |
| 5,153,359 | A | 10/1992 | Lishness | |
| 5,285,590 | A | 2/1994 | Howard | |
| 5,319,871 | A | 6/1994 | Racheli | |
| 5,375,359 | A | 12/1994 | Chesnut et al. | |
| 5,502,913 | A | 4/1996 | Jackson | |
| 5,615,505 | A | 4/1997 | Vaid | |
| 6,898,888 | B2 | 5/2005 | Greenhut | |

(Continued)

FOREIGN PATENT DOCUMENTS

| | | |
|---|---|---|
| CH | 253739 | * 11/1948 |

*Primary Examiner* — Stephen Johnson
(74) *Attorney, Agent, or Firm* — Thompson Coburn LLP

(57) ABSTRACT

A cartridge magazine includes a front wall, a rear wall, first and second side walls, a pair of cartridge retaining lips, and first and second nose-dive control springs. The magazine is adapted to contain two overlapping columns of cartridges in a staggered configuration. Each nose-drive control spring includes a resilient shank portion and a case-engageable end portion adapted and configured to engage with a case of a cartridge. The shank portion extends from one of the side walls to the case-engageable end portion. Each nose-dive control spring is adapted to prevent a cartridge from moving into a nose-dive orientation as a breech face of the firearm pushes the cartridge forward toward the inclined ramp of the firearm.

20 Claims, 4 Drawing Sheets

(56) References Cited

U.S. PATENT DOCUMENTS

| | | | | |
|---|---|---|---|---|
| 7,318,294 | B2 | 1/2008 | Zimmermann | |
| 7,530,191 | B2 | 5/2009 | Szabo | |
| 2014/0259844 | A1* | 9/2014 | Kruse | F41A 9/70<br>42/50 |

* cited by examiner

FIREARM MAGAZINE HAVING NOSE-DRIVE-CONTROL SPRINGS

BACKGROUND

This disclosure pertains to cartridge magazines for use in firearms.

Figure 1:
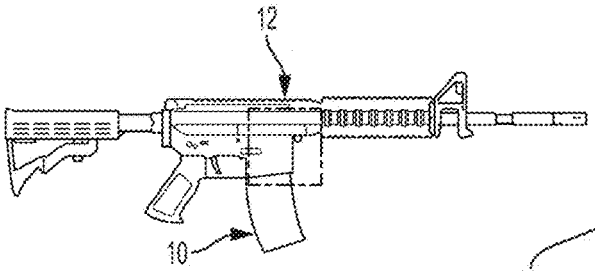
FIG. 1 is a side elevation view of an embodiment of a cartridge magazine positioned within a firearm.

Reference numerals in the written specification and in the drawing figures indicate corresponding items.

DETAILED DESCRIPTION

Figure 1A:
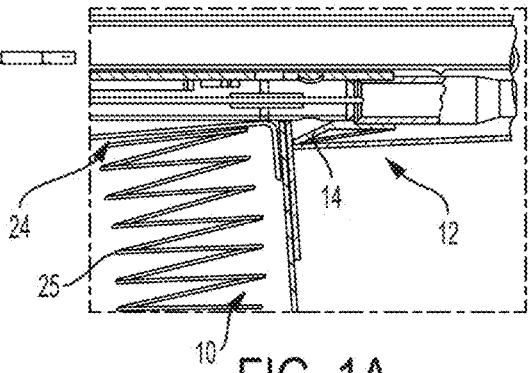
FIG. 1A is an enlarged, cross-sectional view of detail area 1*a* of FIG. 1.
Figure 2:
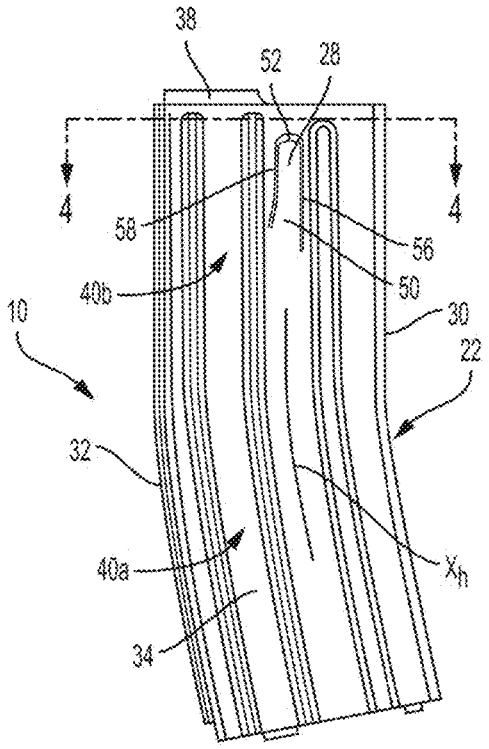
FIG. 2 is a side elevation view of the cartridge magazine shown in FIG. 1.

FIGS. 1 through 8 depict a cartridge magazine generally indicated by reference numeral 10. In FIG. 1, the cartridge magazine 10 is shown inserted in a firearm 12. Additional detail is shown in FIG. 1*a*. The cartridge magazine 10 is adapted for housing a plurality of stacked cartridges and successively dispensing and guiding the uppermost one of the stacked cartridges from the magazine forward toward an inclined ramp 14 leading to a chamber of a barrel of the firearm 12.

The cartridge magazine 10 comprises a housing portion 22, a magazine follower 24, a follower urging spring 25, and two nose-dive control springs 28. The housing portion 22 comprises a front wall 30, a rear wall 32, a first side wall 34, a second side wall 36 and a pair of cartridge retaining lips 38. Each of the first and second side walls 34, 36 are between the front wall 30 and the rear wall 32. The front, rear and side walls define a cartridge compartment 40 extending along a housing axis $X_h$. The cartridge compartment 40 is adapted to contain a plurality of stacked cartridges 26 in a double stack or staggered configuration. The cartridge compartment 40 may have a lower region 40*a* and an upper region 40*b*. The cartridge retaining lips 38 may be disposed along a respective upper edge margin of each of the first and second side walls 34, 36.

Figure 7A:
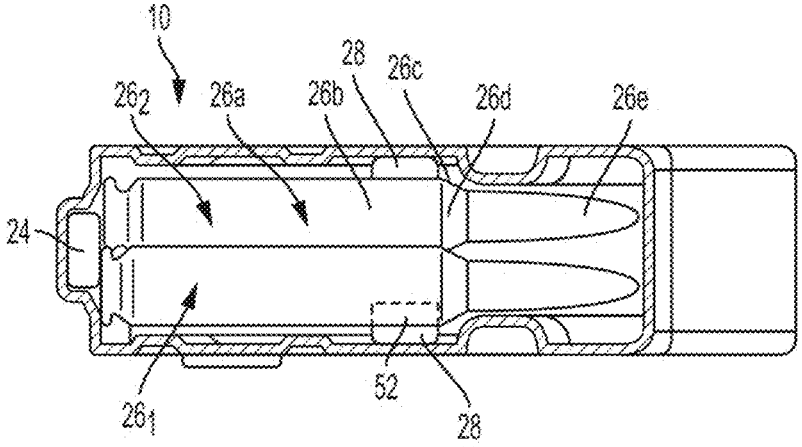
FIG. 7A is a top cross section view of the cartridge magazine shown in FIG. 4 with a plurality of cartridges positioned within the cartridge magazine.
Figure 7B:
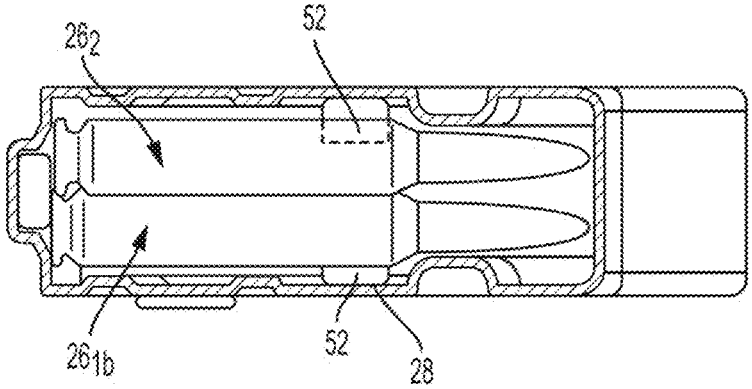
FIG. 7B is a top cross section view of the cartridge magazine shown in FIG. 7A with the top cartridge removed from the cartridge magazine.
Figure 8:
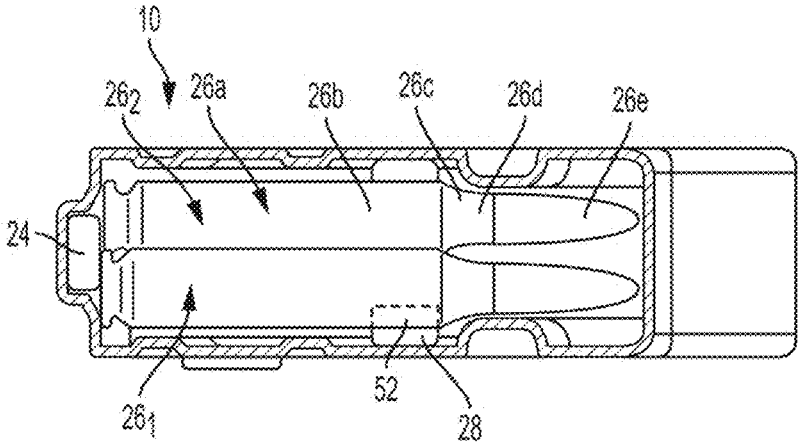
FIG. 8 is the top cross section view of the cartridge magazine shown in FIG. 7A with a plurality of alternative style cartridges positioned within the cartridge magazine.

The magazine follower 24 is within the cartridge compartment 40. The magazine follower 24 is adapted and configured to move within the cartridge compartment 40 generally along the housing axis $X_h$. The magazine follower 24 has a first portion 24*a* and a second portion 24*b*. The first portion and second portion 24*a*,24*b* run parallel to the first and second side walls 34,36 of the magazine. The magazine follower second portion 24*b* is elevated above the first portion 24*a* to facilitate stacking the cartridges in a staggered configuration. The follower urging spring 25 may preferably be a helical spring and is within the cartridge compartment 40. The follower urging spring is adapted and configured to urge the magazine follower 24 toward the upper region 40*b* of the cartridge compartment 40 which presses upwardly against the lowermost cartridges 26 in the stack to position the uppermost cartridge in the stack against the cartridge retaining lips 38. A first cartridge $\mathbf{26}_1$ is shown in FIGS. 7A,7B and 8 in a retaining lips engaging position. A cartridge 26 may have a case 26*a* including a body 26*b*, shoulder 26*c*, and a neck 26*d*. A cartridge 26 may further include a bullet 26*e*. When the cartridge (e.g., cartridge $\mathbf{26}_1$) is in the retaining lips engaging position, the cartridge retaining lips 38 of the housing portion 22 engage the case 26*a* of the cartridge. Specifically, the cartridge retaining lips 38 may engage the body 26*b* of the case 26*a*. The cartridge retaining lips 38 may prevent the cartridge 26 from moving upward along the housing axis $X_h$ beyond the cartridge retaining lips 38. Thus, with the uppermost cartridge (e.g., cartridge $\mathbf{26}_1$ in a first stack) in the retaining lips engaging position, the follower urging spring exerts an upwardly directed force on the cartridge 26 (albeit indirectly via the magazine follower 24 and any other cartridges such as a second cartridge $\mathbf{26}_2$, e.g., a cartridge in a second stack, if any, that may be between the uppermost cartridge and the magazine follower) and the cartridge retaining lips 38 exert an opposite downward force on the cartridge $\mathbf{26}_1$.

Each nose-dive control spring 28 may comprise a resilient shank portion 50 and a case-engageable end portion 52. The shank portion 50 may extend from the first or second side wall 34, 36 (depending on the position of the nose-dive control spring 28) to the case-engageable end portion 52. As such, one end of the shank portion 50 may be supported by the first or second side wall 34, 36 and the opposite end supports the case-engageable end portion 52 of the nose-dive control spring 28. The shank portion 50 may extend from the side wall 34, 36 and terminate before an upper portion of the side wall 34, 36 leaving a gap 53. The case-engageable end portion 52 extends inwardly from the shank portion 50.

Each nose-dive control spring 28 is adapted and configured such that as a cartridge 26 moves upwardly along the housing axis $X_h$ into the retaining lips engaging position (See FIGS. 7A,7B, 8), the case-engageable end portion 52 engages the outer surface of the case 26*a* of the cartridge (top spring in FIG. 7A, bottom spring in FIG. 7*b*). The case engageable end portion 52 is forced outwardly until an at least a part of the lower portion of the bullet 26*e* moves upwardly beyond the case-engageable end portion. Specifically, the case-engageable end portion 52 may engage the body 26*b* of the case 26*a*. In other words, as the case 26*a* of the cartridge 26 moves upwardly along the housing axis $X_h$, it may press against a camming surface of the case-engageable end portion 52 and thereby exert an laterally outwardly directed force against the case-engageable end portion to thereby resiliently flex the shank portion 50 and move the case-engageable end portion 52 out of the path of the cartridge. Preferably, the camming surface of the case-engageable end portion 52 may be shaped such that when the shank portion 50 is in an unflexed orientation, then the case-engageable end portion projects upwardly and inwardly into the path of a case 26*a* moving along the housing axis $X_h$. The camming surface of the case-engageable end portion 52 is shown as a curved surface, but it is to be understood that such surface could be of other shapes (e.g., a flat surface extending upwardly and inwardly). Once the upper portion of the cartridge 26 moves upwardly beyond the case-engageable end portion 52 of the nose-dive control spring 28, the shank portion 50 may resiliently urge the case-engageable end portion 52 inwardly into the upper portion 40*b* of the cartridge compartment 40 and under a lower portion of the case 26*a* (e.g., to the position shown in phantom in FIGS. 7A,7B and 8, i.e., the bottom spring in FIG. 7A, the top spring in FIG. 7B). Specifically, the case-engageable end portion 52 may extend inwardly and under a portion of the body 26*b* of the case 26*a* of the cartridge $\mathbf{26}_1$.

The nose-dive control spring 28 may be adapted and configured to prevent the cartridge $\mathbf{26}_1$ from moving into a nose-dive orientation as a breech face of the firearm 12 pushes the cartridge forward toward an inclined ramp 14 of the firearm. Once the cartridge $\mathbf{26}_1$ is in the retaining lips engaging position with the case-engageable end portion 52 under the lower portion of the case 26*b*, the curved shape of the case-engageable end portion 52 may prevent the cartridge $\mathbf{26}_1$ from engaging the camming surface. As such, the exertion of a downward force on the case-engageable end portion 52 via the cartridge $\mathbf{26}_1$, does not result in an outwardly directed force on the case-engageable end portion 52 and does not cause the shank portion 50 to flex outwardly. Thus, the nose-dive control spring 28 may prevent nose-diving of the cartridge $\mathbf{26}_1$ as the cartridge $\mathbf{26}_1$ is dispensed from the magazine 10.

Preferably, at least the shank portion 50 of one of the two nose-dive control springs 28, the front wall 30, the rear wall 32 and at least one of the first and second side walls 34, 36 together may constitute at least a portion of a unitary one-piece member. The shank portion 50 may be monolithically formed with the side walls 34,36. The shank portion 50 may also be a separate member affixed to the side walls 34, 36. The shank portion 50 may cantileverly extend from the side walls 34,36 and may partially extend inward into the upper region 40*b* of the cartridge compartment 40. The case-engageable end portion 52 may also constitute a portion of such unitary one-piece member. Alternatively, the case-engageable end portion 52 may be a separate piece secured to the shank portion 50. Preferably, the walls of the housing 22 and the entirety of at least one of the nose-dive control springs 28 may be formed together (e.g., by stamping) from a single piece of sheet-metal. Preferably, the shank portion 50 of each nose-dive control spring 28 may be generally flush with the corresponding sidewall 34, 36 when the nose-dive control spring is in its unflexed state. Preferably, the shank portion 50 of each nose-dive control spring 28 may extend upwardly from the corresponding sidewall 34, 36 such that first and second generally vertical slits 56, 58 are defined by opposing edges of the shank portion and the sidewall. The first and second slits may prevent the first sidewall 34 of the housing from interfering with the flexing of the nose-dive control spring 28. The shank portion 50 of the nose-dive control spring may include a button region adapted and configured to be engaged by a limit screw (not shown) extending through a side portion of a firearm magazine well. The limit screw can be used to adjust the effective stiffness of the nose-dive control spring 28 to thereby increase or decrease the force required to move the case-engageable end portion 52 out of the path of a cartridge 26 moving upwardly along the housing axis $X_h$.

The magazine follower 24 may be shaped and configured such that the magazine follower avoids contact with both nose-dive limiting springs 28 as the magazine follower moves upwardly in the cartridge compartment 40 generally along the housing axis $X_h$ to a position in which the magazine follower 24 contacts the cartridge retaining lips 38. In particular, the magazine follower 24 preferably includes two clearance cutouts 64 sized and configured such that the magazine follower avoids contact with the case-engageable end portion 52 of the nose-dive limiting spring 28 as the magazine follower moves upwardly along the housing axis $X_h$ to a position in which the magazine follower contacts the cartridge retaining lips.

Figure 3:
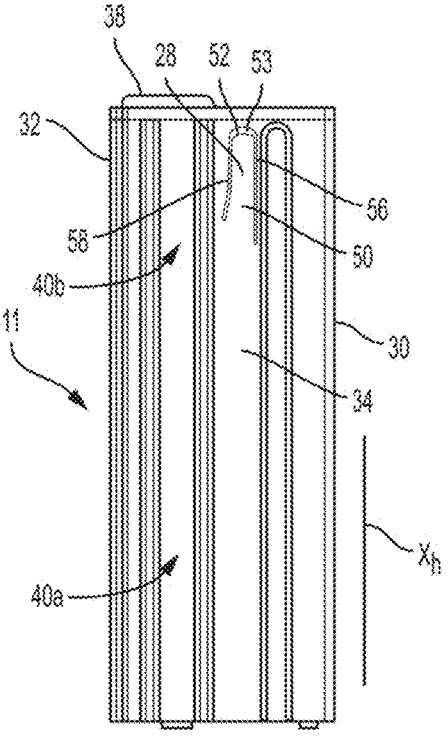
FIG. 3 is a side elevation view of an alternative embodiment of a cartridge magazine for use with the firearm shown in FIG. 1.
Figure 4:
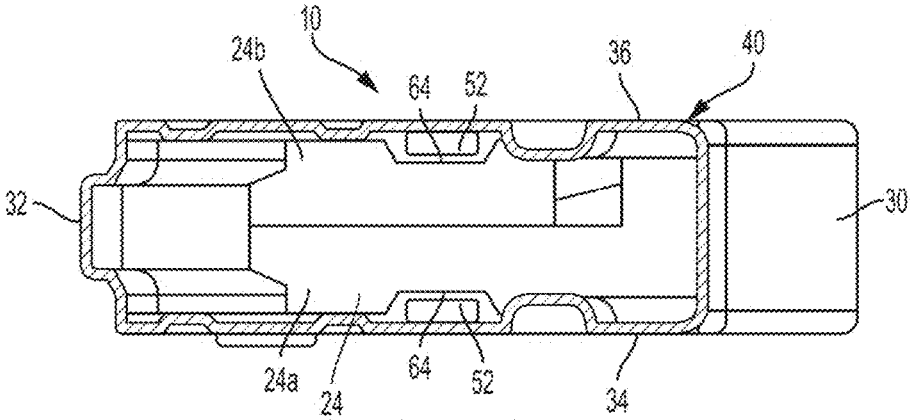
FIG. 4 is a top cross section view of the cartridge magazine shown in FIG. 2.
Figure 5:
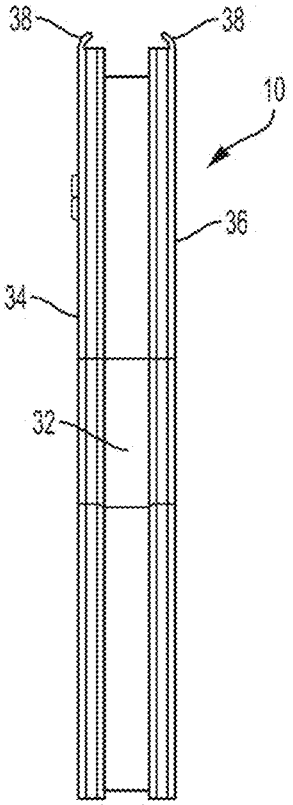
FIG. 5 is a rear view of the cartridge magazine shown in FIG. 2.
Figure 6:
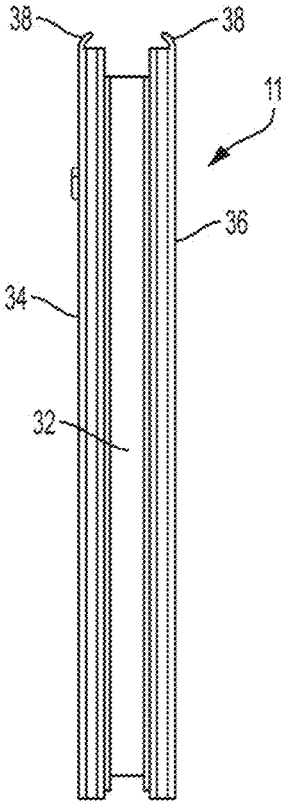
FIG. 6 is a rear view of the cartridge magazine shown in FIG. 3.

Referring to FIGS. 3 and 6, an alternative embodiment of the cartridge magazine 11 is shown. In this alternative embodiment, the cartridge magazine 11 is straight rather than curved. The cartridge magazine 11 has a straight housing axis $X_h$ but is otherwise similar to the cartridge magazine 10. It should be understood that the nose-dive control springs 28 and/or other features disclosed herein are suitable for use with double stack, or staggered, magazines of various configurations not limited to those depicted herein. It should further be understood that the nose-dive control springs 28 and/or other features disclosed here are suitable for use with a single stack magazine. The use of two nose-dive control springs 28 may provide greater stability for a cartridge in a single stack magazine than a single nose-dive control spring 28. This configuration may also provide additional stability in other magazine types such as those that feed a double stacked configuration into a single stack throat which feeds the firearm.

Referring now to FIGS. 7A and 7B, the cartridge magazine 10 provides several advantages. For example, the cartridge magazine 10 includes two nose-dive control springs 28 thus allowing the cartridge magazine 10 to prevent nose-dive in a double stack, or staggered, magazine configuration. For example, this configuration is typically used in assault rifle type firearms and may be used in some pistol type firearms. A single nose-dive control spring 28 would only be effective on half of the cartridges 26 as cartridges are loaded in an alternating pattern. Thus, the use of two nose-dive control springs 28 advantageously may prevent nose-dive in a magazine compatible with assault rifle type firearms and other firearms using a double stack, or staggered, type magazine. As shown in FIG. 7A, a first nose-dive control spring 28 engages a top cartridge in the first stack to prevent nose dive. When that cartridge is removed from the magazine as shown in FIG. 7B, a second nose dive control spring 28 engages a top cartridge in the second stack (now the top most cartridge in the magazine) to prevent nose dive of that cartridge.

Still referring to FIGS. 7A and 7B, with a first cartridge $\mathbf{26}_1$ (in the first stack) in the retaining lips position (e.g., in contact with retaining lips 38), the case-engageable end portion 52 of one of the nose-dive control springs 28 extends partially under the first cartridge $\mathbf{26}_1$ and engages with the body 26*b* of the case 26*a*. This may prevent the first cartridge $\mathbf{26}_1$ from entering a nose-dive orientation as the cartridge $\mathbf{26}_1$ is being extracted from the magazine and loaded into the firearm 12. In this configuration, a second cartridge $\mathbf{26}_2$ (in the second stack) is staggered and partially below the first cartridge $\mathbf{26}_1$. The second cartridge $\mathbf{26}_2$ is not in the retaining lips position as it is prevented from moving further along the housing axis $X_h$ by the first cartridge $\mathbf{26}_1$. In this position, the case-engageable end portion 52 of the second nose-dive control spring 28 engages the top portion and/or a side portion of the body 26*b* of the case 26*a* of the second cartridge $\mathbf{26}_2$.

When the first cartridge $\mathbf{26}_1$, exits the magazine 10, the follower 24 and the urging spring cause the second cartridge $\mathbf{26}_2$ to move into the retaining lips position as shown in FIG. 7B. The second nose-dive control spring 28 on the opposite side of the magazine engages the second cartridge $\mathbf{26}_2$. The shank portion 50 of the second nose-dive control spring 28 causes the case-engageable end portion 52 to move beneath the second cartridge $\mathbf{26}_2$ and engage with the body 26*b*. This may prevent the second cartridge $\mathbf{26}_2$ from entering a nose-dive orientation when loaded from the magazine 10 into the firearm 12. Because the second cartridge $\mathbf{26}_2$ moves into the retaining lips position and the first cartridge $\mathbf{26}_1$ has been removed from the cartridge magazine 10, a third cartridge $\mathbf{26}_m$ in the first stack (if present) formerly below the first cartridge $\mathbf{26}_1$ moves upward. The third cartridge $\mathbf{26}_m$ is not in the retaining lips position as it is prevented from moving further along the housing axis $X_h$ by the second cartridge $\mathbf{26}_2$. In this position, the case-engageable end portion 52 of the first nose-dive control spring 28 engages the top portion and/or a side portion of the body 26*b* of the case 26*a* of the third cartridge $\mathbf{26}_{1b}$.

In some embodiments, only one of the two nose-dive control springs 28 operates to prevent nose-dive for any single cartridge. The other nose-dive control spring 28 does not contact the cartridge in the retaining lips position. For example, assuming that there are at least two cartridges in a double stack magazine, a first nose-dive control spring will contact a first cartridge in the retaining lips position and extend at least partially below the body of the cartridge to prevent nose-dive. A second nose-dive control spring is not in contact with the first cartridge and does not contact cartridges in the stack containing the first cartridge. Rather, the second nose-dive control spring is in contact with a second cartridge in the second stack. Until the second cartridge moves into the retaining lips position (e.g., when the first cartridge is removed), the second nose-dive control spring does not extend under the second cartridge such that nose-dive is prevented. When the second cartridge moves into the retaining lips position, the second nose-dive control spring extends at least partially below the second cartridge to prevent nose-dive. The first nose-dive control spring is not in contact with the second cartridge and does not contact cartridges in the stack containing the second cartridge (i.e., the second stack). In alternative embodiments such as those in which the cartridge magazine is a single stack magazine, both the first and second nose dive control springs operate together to prevent nose-dive and/or provide greater stability to the cartridge in the retaining lips positions.

Referring now to FIGS. 7A and 8, the magazine 10 provides a further advantage in that the placement of the nose-dive control springs 28 may allow for varying types of cartridges to be used in the cartridge magazine 10. A firearm may be compatible with more than one type of ammunition (e.g., both 5.56×45 millimeter and 300 AA Blackout cartridges). In such a case, the varying types of ammunition typically have at least a portion of the body 26*b* of the cartridge case 26*a* having the same diameter. The rest of the cartridge may have varying configurations. The length of the body 26*b*, shape of the shoulder 26*c*, length and diameter of the neck 26*d*, and/or the shape/size of the bullet 26*e* may vary between the types of ammunition. The nose-dive control springs 28 may be placed relative to the rear wall 32 such that the nose-dive control springs 28 contact the body 26*b* (e.g., the commonly shared portion) of multiple types of ammunition. Therefore, the nose-dive control springs 28 may be capable of preventing various types of ammunition from entering a nose-dive orientation and the magazine 10 is compatible with firearms 12 capable of firing varying types of ammunition.

The magazine 10 provides a further advantage in that the placement of the nose-dive control springs 28 may prevent nose-dive while the firearm 12 is firing in a fully automatic mode. Because the nose-dive control springs 28 contact the body 26*b* of the cartridge 26 rather than the bullet 26*e* or the shoulder 26*d*, the nose-dive control springs are not disturbed by the cartridge moving forward and past the nose-dive control spring 28. For example, if the nose-dive control spring 28 were to contact the bullet 26*e* rather than the body 26*b*, the nose-dive control spring 28 would be forced backward or otherwise disturbed by the transition between the bullet 26*e* and the case 26*a* and the nose-dive control spring 28 would be forced backward as the shoulder 26*c* passes the nose-dive control spring 28 as the cartridge is moved from the magazine into the chamber of the firearm. With the nose-dive control spring 28 contacting the body 26*b* of the cartridge, the travel of the cartridge forward into the chamber does not disturb the nose-dive control spring 28 in this manner.

In view of the foregoing, it will be seen that the several advantages of the disclosed magazine are achieved and attained.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements of the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A cartridge magazine for housing a plurality of stacked cartridges and successively dispensing and guiding an uppermost one of the stacked cartridges from the magazine forward toward an inclined ramp leading to a chamber of a barrel of a firearm, the magazine comprising:

a housing portion comprising a front wall, a rear wall, first and second side walls, and a pair of cartridge retaining lips, each of the first and second side walls being between the front wall and the rear wall, the front, rear and side walls defining a cartridge compartment extending along a housing axis, the cartridge compartment being adapted to contain a plurality of stacked cartridges, the cartridge compartment having a lower region and an upper region, the cartridge retaining lips being disposed along a respective upper edge margin of each of the first and second side walls, the cartridge compartment adapted and configured to contain two overlapping columns of cartridges in a staggered configuration;

a magazine follower within the cartridge compartment, the magazine follower being adapted and configured to move within the cartridge compartment generally along the housing axis, the magazine follower having a first portion and a second portion, the first portion and second portion running parallel to the first and second side walls, the second portion elevated above the first portion to facilitate stacking the cartridges in the staggered configuration;

a follower urging spring within the cartridge compartment, the follower urging spring being adapted and configured to urge the magazine follower toward the upper region of the cartridge compartment;

a first nose-dive control spring and a second nose-dive control spring, each said nose-drive control spring comprising a resilient shank portion and a case-engageable end portion adapted and configured to engage with a case of a cartridge, the shank portion extending from one of the side walls to the case-engageable end portion, each said nose-dive control spring being adapted and configured such that as a cartridge moves upwardly along the longitudinal housing axis, the case-engageable end portion is engaged by the case of the cartridge and forced outwardly until a part of the lower portion of the case moves upwardly beyond the case-engageable end portion and the shank portion subsequently resiliently urges the case-engageable end portion inwardly into the upper portion of the cartridge compartment and under a lower portion of the case thereby urging the cartridge into a retaining lips engaging position, the retaining lips engaging position being a position of the cartridge relative to the cartridge magazine in which the case of the cartridge engages the cartridge retaining lips while the respective first and second nose-dive control spring engages the case of the cartridge and at least a portion of the cartridge extends above at least a portion of the upper edge margin of the first side wall and a portion of the upper edge margin of the second side wall, each said nose-dive control spring being adapted and configured to prevent the cartridge from moving into a nose-dive orientation as a breech face of the firearm pushes the cartridge forward toward the inclined ramp of the firearm.

2. A cartridge magazine in accordance with claim 1, wherein the shank portion and case-engageable end portion of one of the nose-dive control springs and at least one of the walls of the housing portion together constitute at least a portion of a unitary one-piece member, and wherein the shank portion of the first and second nose-dive control springs extend upwardly within a portion of the first sidewall, the shank portion terminating prior to the upper edge margin of the first sidewall.

3. A cartridge magazine in accordance with claim 1, wherein the shank portion and case-engageable end portion of one of the nose-dive control springs, at least one of the walls of the housing portion, and at least one or more of the front wall and the rear wall together constitute at least a portion of a unitary one-piece member.

4. A cartridge magazine in accordance with claim 1, wherein the case-engageable end portion of each said nose-dive control spring curves inwardly into the cartridge compartment.

5. A cartridge magazine in accordance with claim 1, wherein the magazine follower is shaped and configured such that the magazine follower avoids contact with each said nose-dive control spring as the magazine follower moves upwardly along the housing axis to a position in which the magazine follower contacts the cartridge retaining lips.

6. A cartridge magazine in accordance with claim 5, wherein the magazine follower includes a first and a second cutout, the first cutout aligned with the first nose-dive control spring, the second cutout aligned with the second nose-dive control spring, the first and second cutouts in the first and second portions of magazine follower, the first and second cutouts adapted and configured to permit the magazine follower to pass the first and second nose-dive control springs within the cartridge compartment.

7. A cartridge magazine in accordance with claim 1, wherein the cartridge compartment and the magazine follower are adapted and configured to receive cartridges of varying configurations, each cartridge having a neck, a shoulder, and a body, wherein all of the cartridges of varying configurations have at least a portion of the body in common, and wherein each said nose-dive control spring is adapted and configured to engage with the case of the cartridges of varying configurations at the portion of the body in common between the cartridges of varying configurations.

8. A cartridge magazine in accordance with claim 1, wherein the housing axis is substantially linear.

9. A cartridge magazine in accordance with claim 1, wherein the housing axis is substantially curved.

10. A cartridge magazine in accordance with claim 1, wherein the shank portion of each said nose-dive control spring is generally flush with one of the first side wall and the second side wall when the respective first and second nose-dive control spring is in an unflexed state.

11. A combination comprising at least two cartridges and a cartridge magazine, the cartridge magazine housing the at least two cartridges, the cartridge magazine being adapted and configured to successively dispense and guide one of the two cartridges from the magazine forward toward an inclined ramp leading to a chamber of a barrel of a firearm, the magazine comprising a housing portion, a magazine follower, a follower urging spring, and a first and second nose-dive control spring, each cartridge having a case and a bullet;

the housing portion comprising a front wall, a rear wall, first and second side walls, and a pair of cartridge retaining lips, each of the first and second side walls being between the front wall and the rear wall, the front, rear and side walls defining a cartridge compartment extending along a housing axis, the cartridge compartment containing the two cartridges, the cartridge compartment having a lower region and an upper region, the cartridge retaining lips being disposed along a respective upper edge margin of each of the first and second side walls;

the magazine follower being within the cartridge compartment, the magazine follower being adapted and configured to move within the cartridge compartment generally along the housing axis;

the follower urging spring being within the cartridge compartment, the follower urging spring being adapted and configured to urge the magazine follower toward the upper region of the cartridge compartment;

each of the first and second nose-dive control springs comprising a resilient shank portion and a case-engageable end portion adapted and configured to engage with a case of a cartridge, the shank portion extending from one of the side walls to the case-engageable end portion, each said nose-dive control spring being adapted and configured such that as one of the cartridges moves upwardly along the longitudinal housing axis into a retaining lips engaging position in which the cartridge retaining lips engage the case of the cartridge, the case-engageable end portion of at least one of the nose-dive control springs is engaged by the case of the cartridge and forced outwardly until a part of a lower portion of the cartridge moves upwardly beyond the case-engageable end portion and the shank portion subsequently resiliently urges the case-engageable end portion inwardly into the upper portion of the cartridge compartment and under a lower portion of the case; and a first of the two cartridges being within the housing and in the retaining lips engaging position and a second of the two cartridges being within the housing not in the retaining lips engaging position.

12. A combination in accordance with claim 11, wherein each said nose-dive control spring is adapted and configured to prevent one of the two cartridges from moving into a nose-dive orientation as a breech face of the firearm pushes the cartridge forward toward the inclined ramp of the firearm.

13. A combination in accordance with claim 12, wherein each said nose-dive control spring is adapted and configured such that with a first of the two cartridges in the retaining lips engaging position the first nose-dive control spring is in contact with a lower portion of the case of the first cartridge such that the first nose-dive control spring prevents the first cartridge from moving into a nose-dive orientation and the second nose-dive control spring is in contact with the second cartridge such that the case-engageable end portion is engaged by the case of the cartridge and forced outwardly.

14. A combination in accordance with claim 11, wherein the second of the two cartridges is offset from the first cartridge in a direction running between the first and second side walls.

15. A combination in accordance with claim 11, wherein the shank portion and case-engageable end portion of one of the nose-dive control springs, at least one of the walls of the housing portion, and at least one or more of the front wall and the rear wall together constitute at least a portion of a unitary one-piece member.

16. A combination in accordance with claim 11, wherein the case-engageable end portion of each said nose-dive control spring curves inwardly into the cartridge compartment.

17. A combination in accordance with claim 11, wherein the magazine follower is shaped and configured such that the magazine follower avoids contact with each said nose-dive control spring as the magazine follower moves upwardly along the housing axis to a position in which the magazine follower contacts the cartridge retaining lips.

18. A combination in accordance with claim 17, wherein the magazine follower includes a first and a second cutout, the first cutout aligned with the first nose-dive control spring, the second cutout aligned with the second nose-dive control spring, the first and second cutouts in the first and second portions of magazine follower, the first and second cutouts adapted and configured to permit the magazine follower to pass the first and second nose-dive control springs within the cartridge compartment.

19. A combination in accordance with claim 11, wherein the cartridge compartment and the magazine follower are adapted and configured to receive cartridges of varying configurations, each cartridge having a neck, a shoulder, and a body, wherein all of the cartridges of varying configurations have at least a portion of the body in common, and wherein each said nose-dive control spring is adapted and configured to engage with the case of the cartridges of varying configurations at the portion of the body in common between the cartridges of varying configurations.

20. A combination in accordance with claim 11, wherein the shank portion of each said nose-dive control spring is generally flush with one of the first side wall and the second side wall when the nose-dive control spring is in an unflexed state.

* * * * *